US010287815B2

(12) United States Patent
Kitamura et al.

(10) Patent No.: US 10,287,815 B2
(45) Date of Patent: May 14, 2019

(54) DOOR OPERATOR

(71) Applicant: MITSUI KINZOKU ACT CORPORATION, Yokohama-shi, Kanagawa (JP)

(72) Inventors: Yosuke Kitamura, Kanagawa (JP); Naoki Taniguchi, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 206 days.

(21) Appl. No.: 15/262,388

(22) Filed: Sep. 12, 2016

(65) Prior Publication Data

US 2017/0211308 A1 Jul. 27, 2017

(30) Foreign Application Priority Data

Jan. 21, 2016 (JP) ..... 2016-009614

(51) Int. Cl.

*E05F 15/08* (2006.01)
*E05F 15/616* (2015.01)
*E05F 15/63* (2015.01)

(52) U.S. Cl.

CPC ..... *E05F 15/616* (2015.01); *E05F 15/63* (2015.01); *E05Y 2201/434* (2013.01); *E05Y 2201/686* (2013.01); *E05Y 2900/531* (2013.01)

(58) Field of Classification Search

CPC ..... E05F 15/616; E05F 15/619; B60J 5/047; B60J 5/10; B60J 15/12; E05Y 2201/434;
(Continued)

(56) References Cited

U.S. PATENT DOCUMENTS 3,816,962 A * 6/1974 Ladd ..... E05F 11/382 49/103
3,900,965 A * 8/1975 Mummert ..... E05F 11/382 49/103

(Continued)

FOREIGN PATENT DOCUMENTS

JP 58-178774 A 10/1983
JP 2000-096910 A 4/2000
JP 2005-320784 A 11/2005

OTHER PUBLICATIONS

Japanese Office Action issued in corresponding Japanese Patent Application No. 2016-009614, dated Mar. 5, 2019, with English Translation.

*Primary Examiner* — Chi Q Nguyen
(74) *Attorney, Agent, or Firm* — McDermott Will & Emery LLP

(57) ABSTRACT

A door operator opens and closes a side door supported on a side of a vehicle body through a hinge, and includes: a drive unit arranged in an inner space of the side door; and a link mechanism configured to connect an output shaft of the drive unit and the vehicle body. The link mechanism includes a driving arm extending radially from the output shaft of the drive unit, and a driven arm turnably connected to the vehicle body. The link mechanism is configured to open and close the side door with respect to the vehicle body through the driving arm and the driven arm when the drive unit is driven, and the driven arm and the driving arm are connected to each other while allowing for a change in distance from a relative pivot core to a shaft core of the output shaft.

9 Claims, 19 Drawing Sheets

(58) Field of Classification Search
CPC ..... E05Y 2201/686; E05Y 2900/531; E05Y 2201/246; E05Y 2201/722; E05Y 2900/546; E05Y 2201/216
USPC ... 49/31, 413, 146, 502, 340, 346, 354, 351, 49/359, 358, 345; 292/244
See application file for complete search history.

(56) References Cited

U.S. PATENT DOCUMENTS

| | | | | | |
|---|---|---|---|---|---|
| 4,069,616 | A * | 1/1978 | Doveinis | E05F 11/382 | 49/103 |
| 4,221,079 | A * | 9/1980 | Becker | E05F 11/445 | 49/227 |
| 4,986,029 | A * | 1/1991 | Richter | E05F 11/445 | 49/349 |
| 5,850,711 | A * | 12/1998 | Takahashi | B60J 1/17 | 49/351 |
| 6,401,392 | B1 * | 6/2002 | Yuge | E05F 15/619 | 49/340 |
| 8,069,611 | B2 * | 12/2011 | Kitayama | E05F 5/003 | 49/26 |
| 2004/0244294 | A1 * | 12/2004 | Schachtl | E05F 15/614 | 49/339 |
| 2007/0120394 | A1 * | 5/2007 | Nakamori | B60J 5/0425 | 296/146.6 |
| 2008/0295408 | A1 | 12/2008 | Heissler | | |
| 2010/0095595 | A1 * | 4/2010 | Hanaki | E05D 15/101 | 49/359 |
| 2010/0287838 | A1 * | 11/2010 | Kitayama | E05F 5/003 | 49/156 |
| 2011/0314740 | A1 * | 12/2011 | Mori | E05F 11/445 | 49/349 |

* cited by examiner

DOOR OPERATOR

CROSS-REFERENCE TO RELATED APPLICATION

The present application claims priority to and incorporates by reference the entire contents of Japanese Patent Application No. 2016-009614 filed in Japan on Jan. 21, 2016.

BACKGROUND

1. Field

The present disclosure relates to a door operator that opens and closes a side door supported on a side of a vehicle body through a hinge.

2. Description of the Related Art

A vehicle configured to assist in opening and closing a door with a drive unit is already available. The drive unit mounted to the vehicle of this kind is generally configured to cause an output arm to turn by driving a motor. A unit body of the drive unit is attached to a vehicle body while the output arm is connected to the door. When the motor of the drive unit is driven, the output arm turns to be able to move the door in a direction to be opened or closed with respect to the vehicle body. When the drive unit is operated while a striker and a latch are disengaged, for example, the door opened halfway obtains assistance to be opened so that the door may be opened with a small operating force. When the drive unit is operated in an opposite direction while the door is open, the door may be closed without touching it with a hand (for example, refer to Japanese Laid-open Patent Publication No. 2005-320784).

Here, as disclosed in Japanese Laid-open Patent Publication No. 2005-320784, it is easy to secure space for attaching the drive unit to the vehicle body at a back door of the vehicle. A side door of the vehicle is however provided at an opening through which a person gets in and out of the vehicle. Accordingly, considering the comfort of a person getting in and out of the vehicle and the interior comfort, it is difficult to secure the space for attaching the drive unit on a ceiling or floor of the vehicle. Moreover, in the drive unit described in Japanese Laid-open Patent Publication No. 2005-320784, a shaft member of the output arm (a final output shaft of the drive unit) is arranged along a direction perpendicular to an output shaft of the motor, so that a relatively large space is required to install the unit and that it is difficult to accommodate the unit inside the side door.

SUMMARY

It is an object of the present disclosure to at least partially solve the problems in the conventional technology.

A door operator according to one aspect of the present disclosure opens and closes a side door supported on a side of a vehicle body through a hinge, and includes: a drive unit arranged in an inner space of the side door; and a link mechanism configured to connect an output shaft of the drive unit and the vehicle body. The link mechanism includes a driving arm extending radially from the output shaft of the drive unit, and a driven arm turnably connected to the vehicle body. The link mechanism is configured to open and close the side door with respect to the vehicle body through the driving arm and the driven arm when the drive unit is driven, and the driven arm and the driving arm are connected to each other while allowing for a change in distance from a relative pivot core to a shaft core of the output shaft.

A door operator according to another aspect of the preset disclosure opens and closes a side door supported on a side of a vehicle body through a hinge, and includes: a drive unit arranged in an inner space of the side door; and a link mechanism configured to connect an output shaft of the drive unit and the vehicle body. The link mechanism includes a driving arm extending radially from the output shaft of the drive unit, an intermediate arm turnably connected to a tip end of the driving arm, and a driven arm turnably connected to the vehicle body. The link mechanism is configured to open and close the side door with respect to the vehicle body through the driving arm, the intermediate arm and the driven arm when the drive unit is driven, and the intermediate arm and the driving arm are connected to each other while allowing for a change in distance from a relative pivot core to a shaft core of the output shaft.

The above and other objects, features, advantages and technical and industrial significance of this disclosure will be better understood by reading the following detailed description of presently preferred embodiments of the disclosure, when considered in connection with the accompanying drawings.

BRIEF DESCRIPTION OF THE DRAWINGS

FIG. 8A is an enlarged plan view when the side door is closed, FIG. 8B is an enlarged plan view when the side door is half open, and FIG. 8C is an enlarged plan view when the side door is open;

FIG. 15A is an enlarged plan view when the side door is closed, FIG. 15B is an enlarged plan view when the side door is half open, and FIG. 15C is an enlarged plan view when the side door is open;

DETAILED DESCRIPTION

Preferred embodiments of a door operator according to the present disclosure will now be described in detail with reference to the drawings.

First Embodiment

Figure 1:
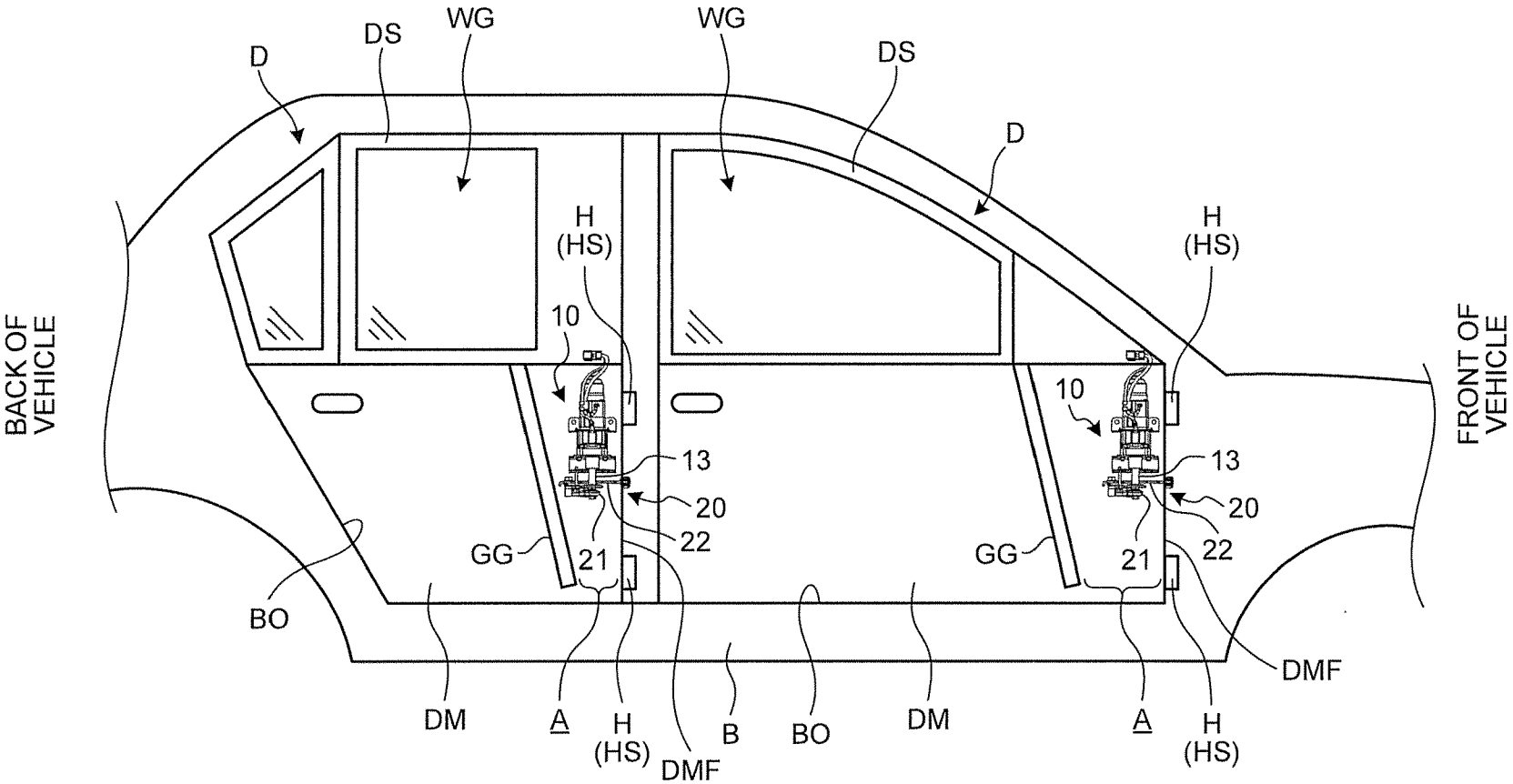
FIG. 1 is a side view schematically illustrating a vehicle to which a door operator according to a first embodiment of the present disclosure is applied.

FIG. 1 illustrates a vehicle to which a door operator according to a first embodiment of the present disclosure is applied. The vehicle illustrated in this case is a four-door, four-wheel vehicle provided with a front side door D and a rear side door D on each of both sides of a vehicle body B. Each of the front side door D and the rear side door D includes a hollow door body DM and a frame-shaped sash DS provided above the door body DM. Each side door D is connected to the vehicle body B by an upper hinge H and a lower hinge H provided on a front face DMF of the door body DM, and turns about a hinge axis HS along a vertical direction to be able to open and close a boarding and alighting opening BO of the vehicle body B.

Window glass WG is arranged in the sash DS of the side door D as illustrated in FIG. 1. The window glass WG is configured to move in the vertical direction along a hoisting guide GG by a hoisting mechanism (not illustrated) arranged inside the door body DM, and may shut an opening of the sash DS when moving upward. When moving downward, the window glass WG is accommodated inside the door body DM to be able to open the opening of the sash DS.

Figure 3:
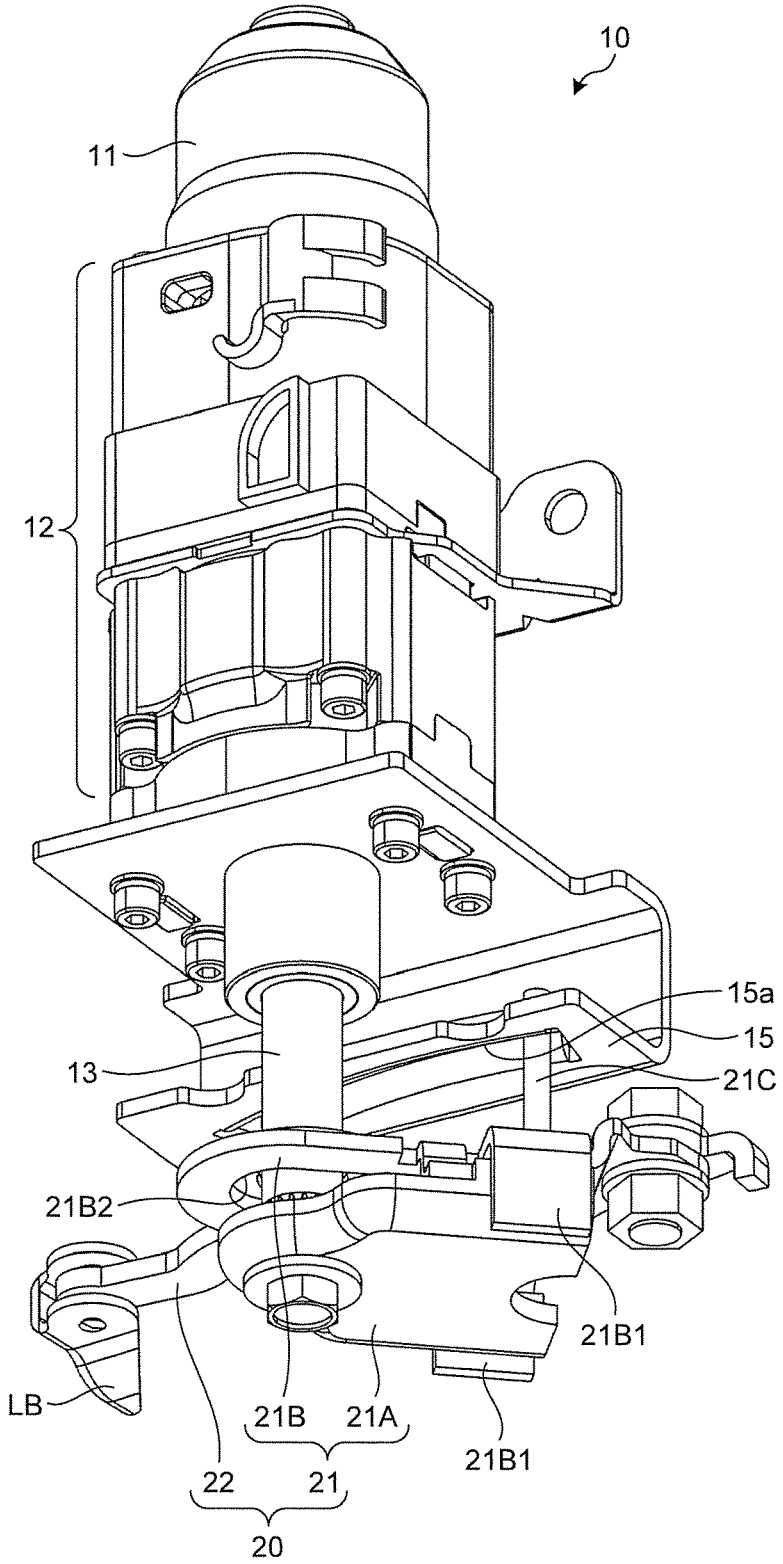
FIG. 3 is an external perspective view of the door operator applied to the vehicle illustrated in FIG. 1 and viewed upward at an angle from an outer side of the vehicle.
Figure 4:
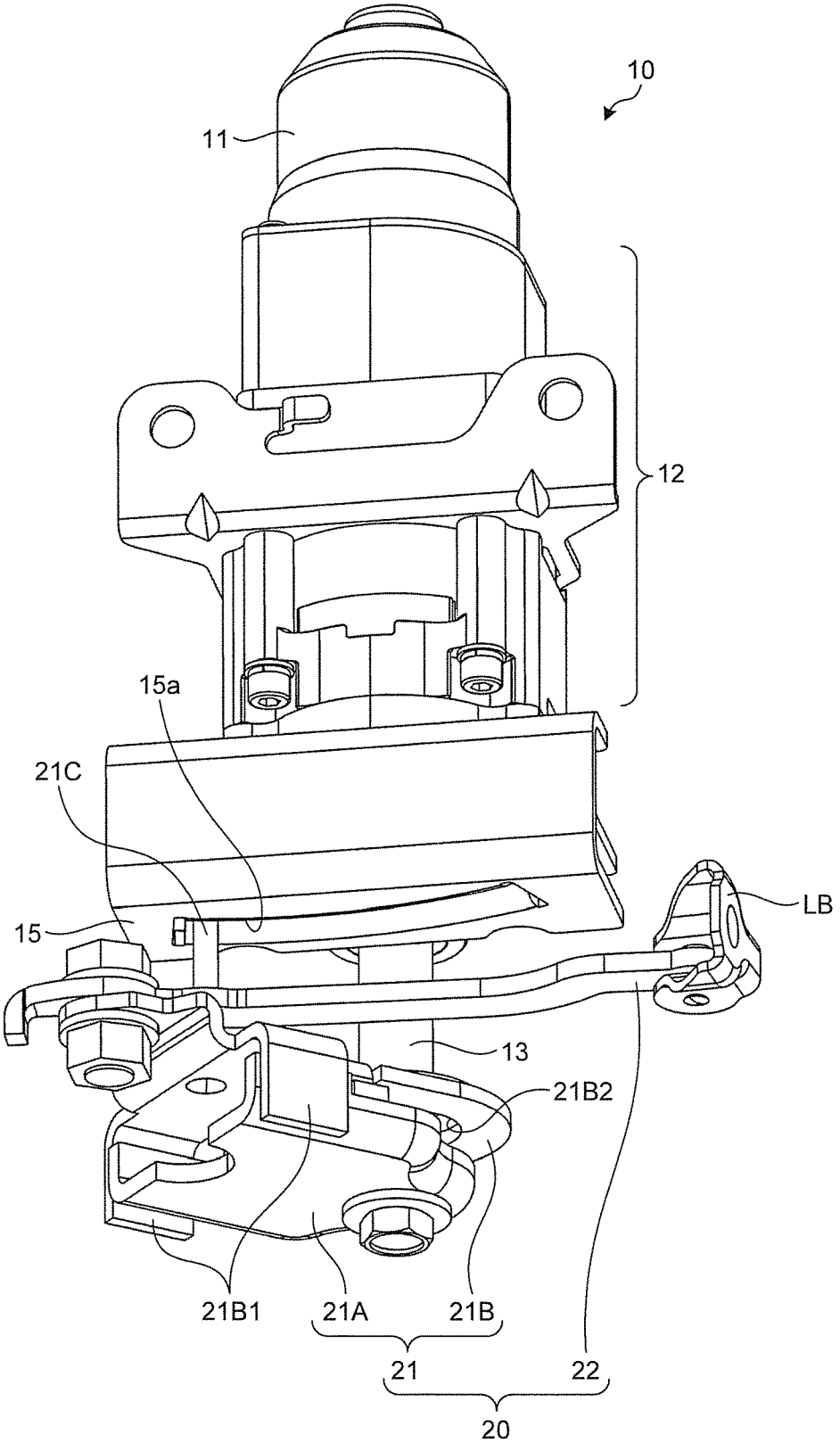
FIG. 4 is an external perspective view of the door operator applied to the vehicle illustrated in FIG. 1 and viewed upward at an angle from an inner side of the vehicle.
Figure 5:
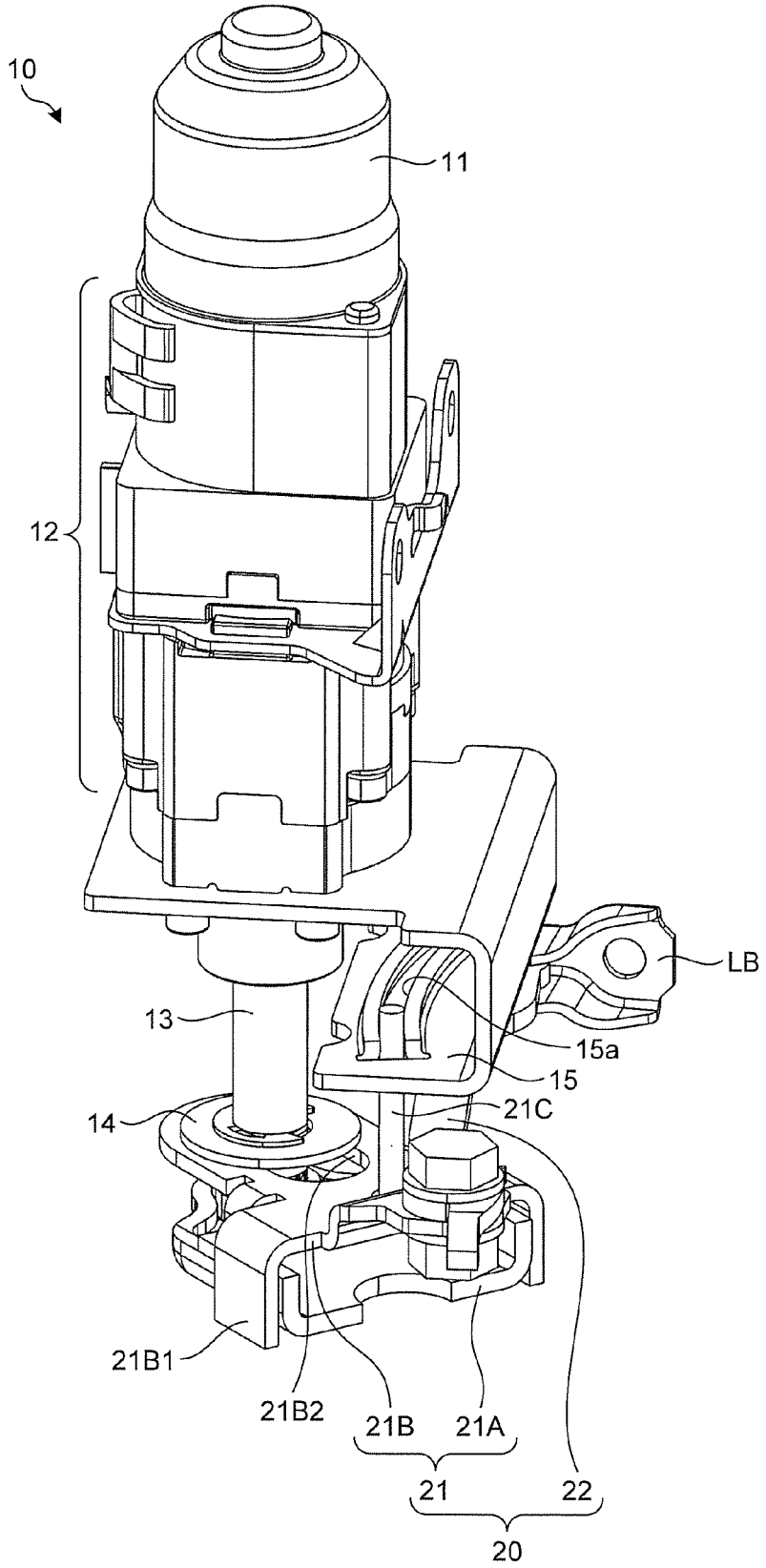
FIG. 5 is an external perspective view of the door operator applied to the vehicle illustrated in FIG. 1 and viewed downward at an angle.
Figure 6:
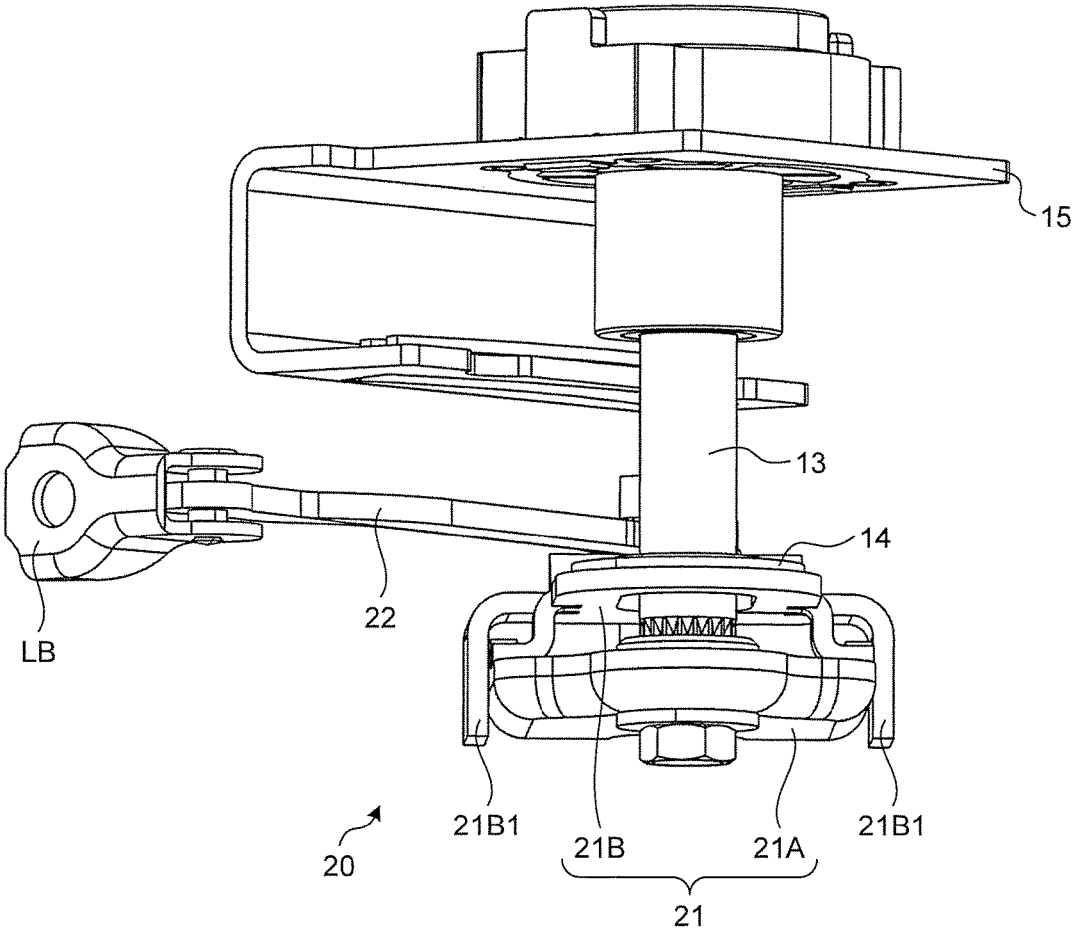
FIG. 6 is an external perspective view of an output shaft and a link mechanism of the door operator applied to the vehicle illustrated in FIG. 1, as viewed from the side.
Figure 7:
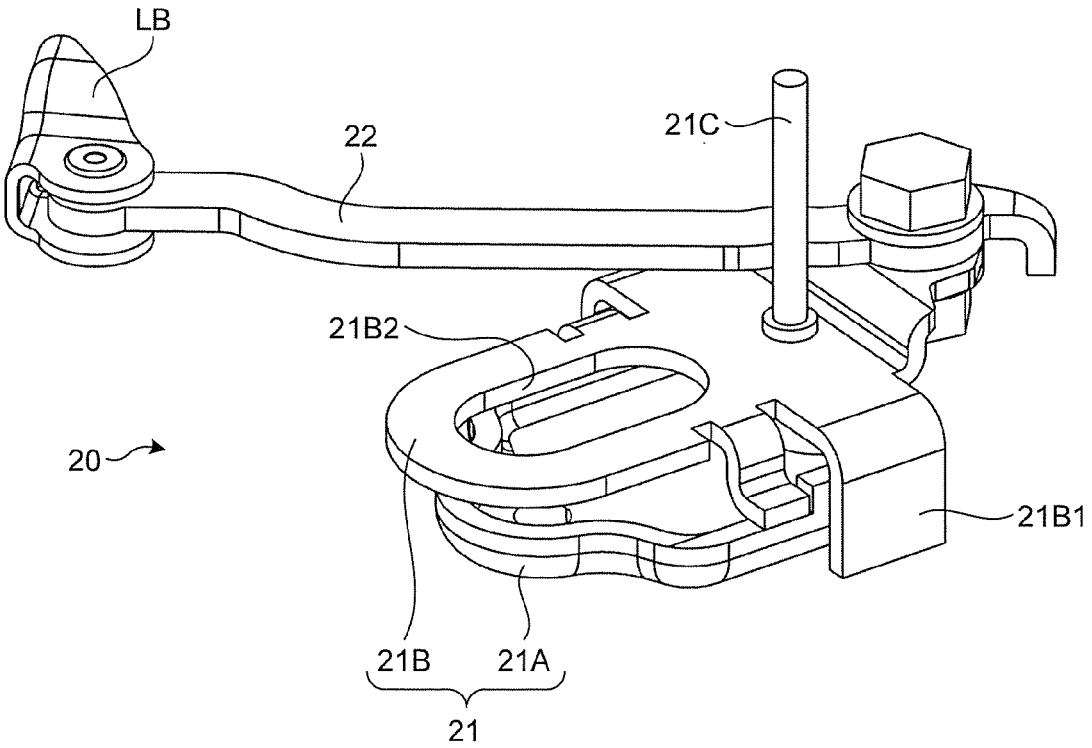
FIG. 7 is an external perspective view of the link mechanism of the door operator applied to the vehicle illustrated in FIG. 1, as viewed downward at an angle.

Each side door D is further provided with a drive unit 10 inside the door body DM. The drive unit 10 is adapted to assist in opening and closing the side door D with respect to the vehicle body B. In the first embodiment, the drive unit 10 includes an electric motor 11 to be a driving source, a decelerator 12, and an output shaft 13 as illustrated in FIGS. 3 to 5. Although not clearly illustrated in the figures, a decelerator including a plurality of gears like a planetary gear mechanism may be applied as the decelerator 12. A clutch mechanism may also be interposed between the electric motor 11 and the output shaft 13 to cut off transmission of power from the electric motor 11 when the side door D is operated manually.

Figure 2:
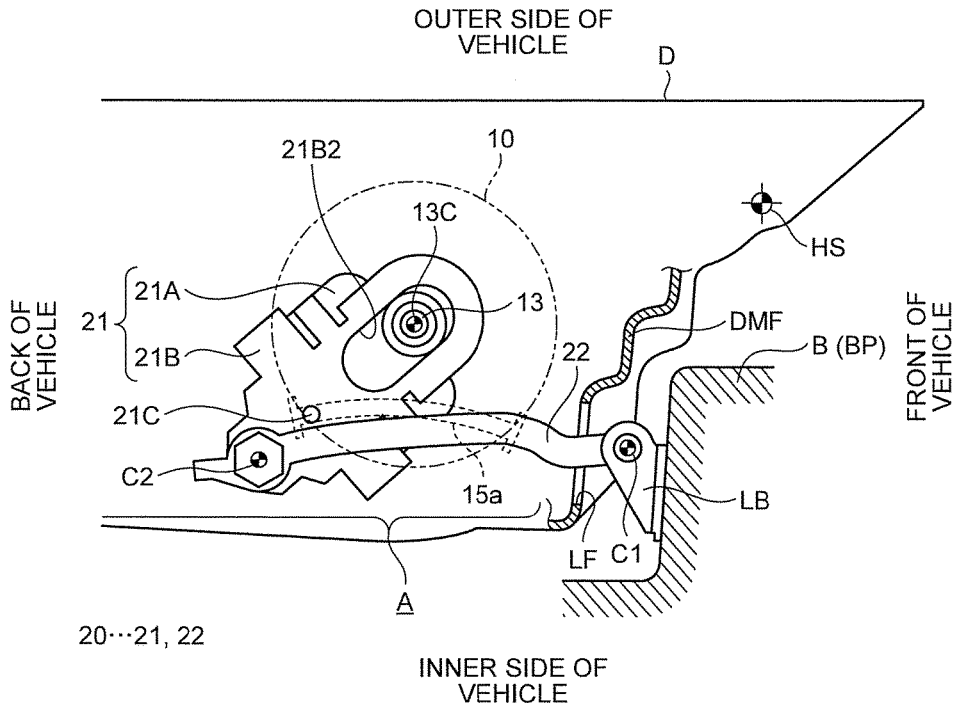
FIG. 2 is an enlarged plan view schematically illustrating an area of connection between a side door and a vehicle body of the vehicle illustrated in FIG. 1.

The drive unit 10 is mounted inside each side door D of the aforementioned vehicle such that the electric motor 11 is located at an upper part while the output shaft 13 extends substantially vertically downward, as illustrated in FIG. 1. The drive unit 10 is mounted in inner space A between the front face DMF on which the hinge H is mounted and the hoisting guide GG inside the door body DM. More specifically, as illustrated in FIG. 2, the drive unit 10 is mounted inside the side door D such that the output shaft 13 is positioned on the inner and back sides of the vehicle relative to the hinge axis HS of the side door D that is closed. The output shaft 13 of the drive unit 10 is connected to the vehicle body B through a link mechanism 20.

The link mechanism 20 is adapted to open and close the side door D with respect to the boarding and alighting opening BO of the vehicle body B when the output shaft 13 is rotated by the electric motor 11 being driven. In the first embodiment, the link mechanism 20 includes a driving arm 21 fixed to the output shaft 13 and a driven arm 22 connecting the driving arm 21 and a part of the vehicle body B such as a pillar BP facing the front face DMF of the side door D.

As illustrated in FIGS. 3 to 7, the driving arm 21 includes a first arm element 21A and a second arm element 21B that are connected to be able to slide relatively along a longitudinal direction. Specifically, a guide projection 21B1 is provided on each of both sides of a base end of the second arm element 21B, and the first arm element 21A is arranged between the guide projections 21B1 to be able to slide along the longitudinal direction and not be able to undergo relative rotation. Moreover, a groove 21B2 is formed along the longitudinal direction at a tip end of the second arm element 21B. The output shaft 13 is fixed to a base end of the first arm element 21A of the driving arm 21 through the groove 21B2 of the second arm element 21B. Although not clearly illustrated in the figures, the first arm element 21A and the output shaft 13 are spline coupled and thus do not undergo relative rotation about a shaft core 13C of the output shaft 13. The second arm element 21B is sandwiched between the first arm element 21A and a washer 14 fixed to the output shaft 13. As a result, the first arm element 21A and the second arm element 21B move relatively only along a radial direction with respect to the output shaft 13 but do not undergo a relative movement along the shaft core 13C of the output shaft 13.

In the first embodiment, as illustrated in FIG. 2, the driving arm 21 is in a standby state when the tip end is tilted backward by approximately 40° toward the inner side of the vehicle. When the electric motor 11 is driven from this state, the driving arm 21 may be turned to a position at which the tip end faces the inner side of the vehicle and to a position at which the tip end is tilted frontward by approximately 25° while the tip end of the arm passes the inner side of the vehicle relative to the output shaft 13.

A base end of the driven arm 22 is turnably connected to the pillar BP of the vehicle body B through a link bracket LB. A tip end of the driven arm 22 enters the inner space A of the side door D through a notch LF provided on the front face DMF of the side door D, and is turnably connected to the base end of the second arm element 21B of the driving arm 21. Each of a pivot core C1 of the driven arm 22 and the link bracket LB and a pivot core C2 of the driven arm 22 and the second arm element 21B is set to be substantially parallel to the shaft core 13C of the output shaft 13. As is apparent from the figures, the length of the driven arm 22 is set such that the arm extends along the front and back of the vehicle when the driving arm 21 is in the standby state with the side door D closed.

As illustrated in FIGS. 2 to 7, a positioning pin 21C projects on a top surface of a tip end side of the second arm element 21B of the driving arm 21. The positioning pin 21C is a columnar member extending substantially vertically upward from the second arm element 21B, where an extended end of the pin is inserted into a slide groove 15*a* of a guide plate 15. The guide plate 15 is a plate-like member fixed to a lower part of the drive unit 10 and extends to be substantially orthogonal to the output shaft 13. As illustrated in FIG. 2, the slide groove 15*a* is provided along the front and back of the vehicle at a position on the inner side of the vehicle relative to the output shaft 13, and is curved to be slightly convex toward the outer side of the vehicle. That is, the slide groove 15*a* provided in the guide plate 15 guides the positioning pin 21C to gradually get closer to the output shaft 13 of the drive unit 10 while the driving arm 21 is turned frontward from the standby state up to a position substantially perpendicular from the output shaft 13 to the inner side of the vehicle. After that, while the driving arm is turned frontward from the position substantially perpendicular to the front and back of the vehicle, the slide groove 15*a* is formed to guide the positioning pin 21C to be gradually separated from the output shaft 13 of the drive unit 10.

Figure 8A:
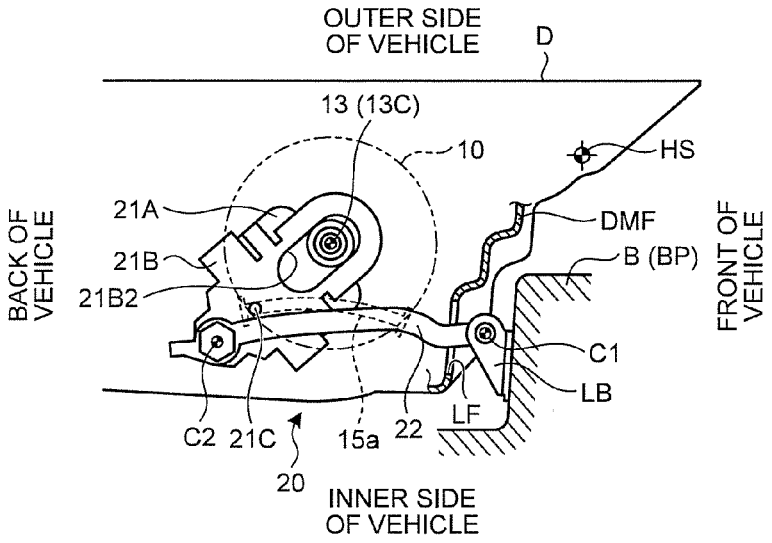
FIGS. 8A to 8C are diagrams schematically illustrating an area of connection between the side door and the vehicle body of the vehicle illustrated in FIG. 1, where

According to the door operator configured as described above, when the electric motor 11 of the drive unit 10 in the standby state with the side door D closed as illustrated in FIG. 8A is driven, the rotation of the output shaft 13 is transmitted to the driven arm 22 through the driving arm 21 to push the driven arm 22 frontward. As a result, when the drive unit 10 is operated while a striker (not illustrated) provided to the vehicle body B and a latch device provided to the side door D are disengaged, for example, the driven arm 22 gradually projects frontward to the outside from the front face DMF of the side door D to thus open up the side door D with respect to the vehicle body B about the hinge axis HS, as illustrated in FIGS. 8B and 8C.

Figure 8B:
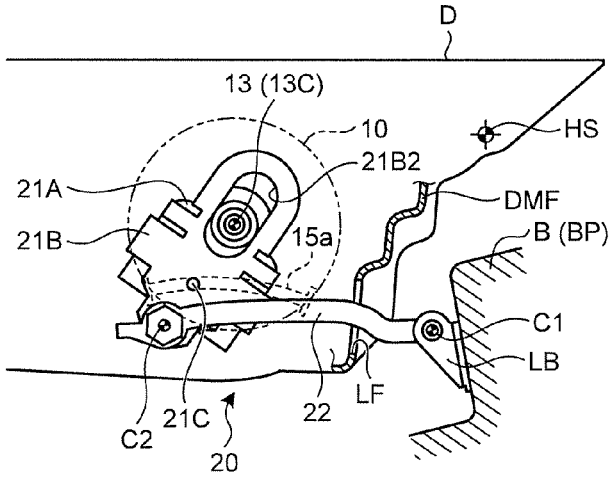
Figure 8C:
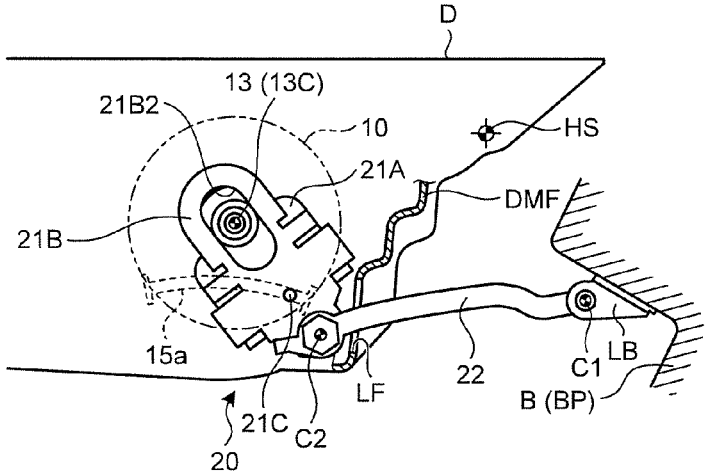

On the other hand, when the electric motor 11 of the drive unit 10 is rotated in a reverse direction from the state in which the side door D is open, the driven arm 22 moves backward to be accommodated in the inner space A of the side door D as from a state illustrated in FIG. 8C to a state illustrated in FIG. 8B, so that the side door D may be closed with respect to the vehicle body B as illustrated in FIG. 8A.

The drive unit 10 is configured to allow for a change in distance from the relative pivot core C2 of the driving arm 21 and the driven arm 22 to the shaft core 13C of the output shaft 13 while the aforementioned operations are in action. Moreover, the second arm element 21B of the driving arm 21 is configured such that the positioning pin 21C moves through the slide groove 15*a* in the guide plate 15 while the relative pivot core C2 of the driving arm 21 and the driven arm 22 is guided along the slide groove 15*a* provided in the guide plate 15.

As a result, the driven arm 22 does not move much toward the inner and outer sides of the vehicle body B even when the driving arm 21 is turned to a considerable extent to open the side door D widely. Therefore, according to the vehicle to which the aforementioned door operator is applied, the side door D may be opened and closed at a wide turning angle without the need to set a large dimension to the notch LF provided on the front face DMF of the side door D or provide a clearance in the pillar BP of the vehicle body B facing the notch. Moreover, according to the drive unit 10 accommodated in the side door D, only the driven arm 22 is exposed to the outside from the front face DMF of the side door D so that there is no influence on a cabin of the vehicle nor are the comfort of getting in and out of the vehicle and the interior comfort impaired.

Second Embodiment

Figure 9:
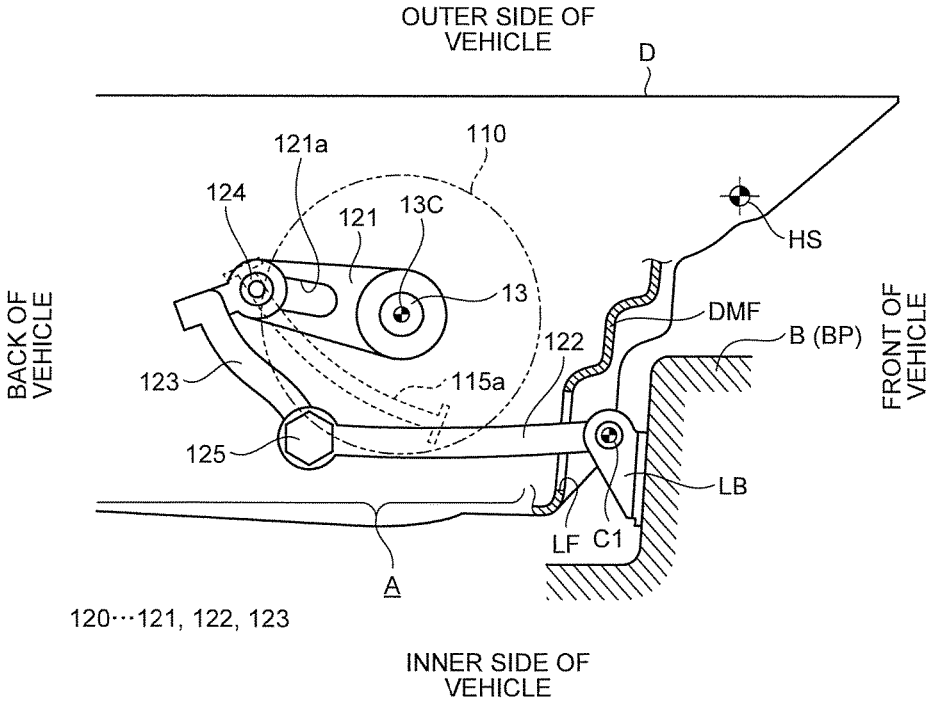
FIG. 9 is an enlarged plan view schematically illustrating an area of connection between a side door and a vehicle body of a vehicle according to a second embodiment of the present disclosure.
Figure 10:
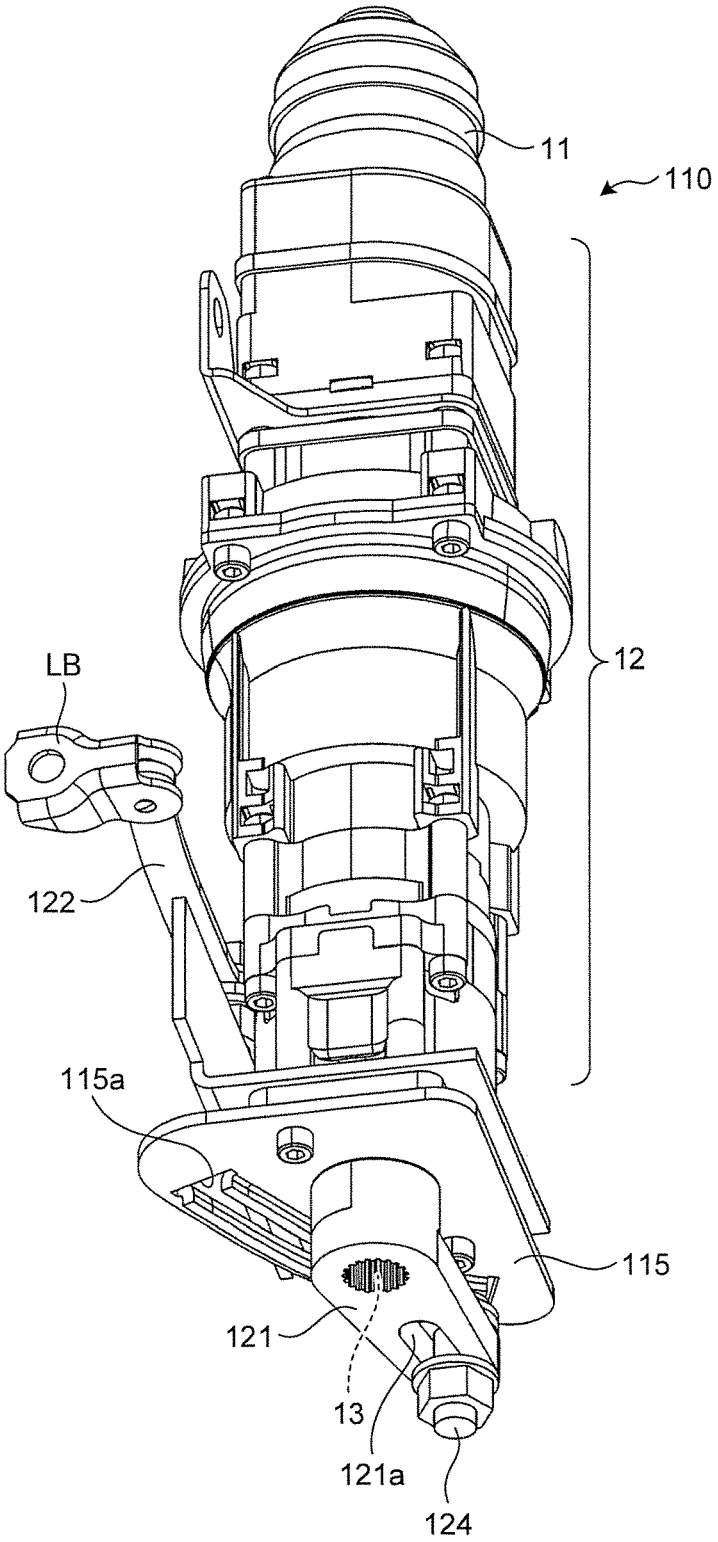
FIG. 10 is an external perspective view of a door operator applied to the vehicle illustrated in FIG. 9 and viewed upward at an angle.
Figure 11:
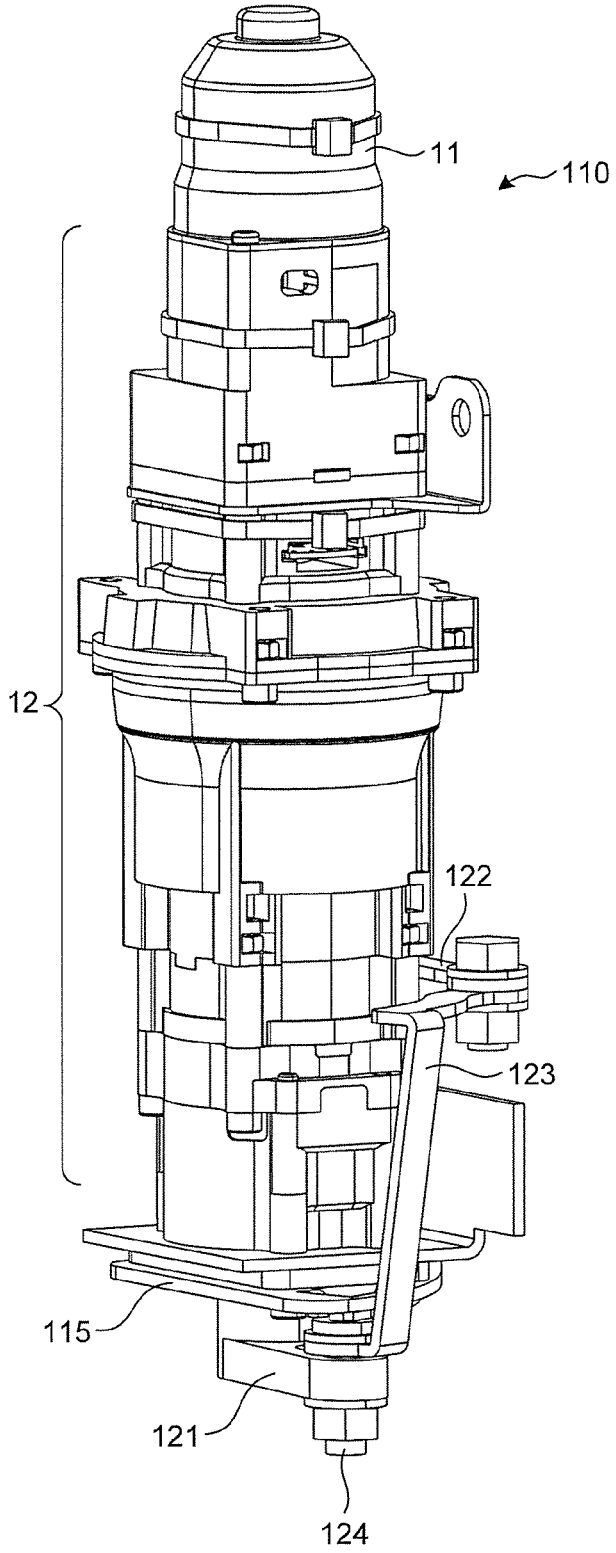
FIG. 11 is an external perspective view of the door operator applied to the vehicle illustrated in FIG. 9 and viewed from the side.
Figure 12:
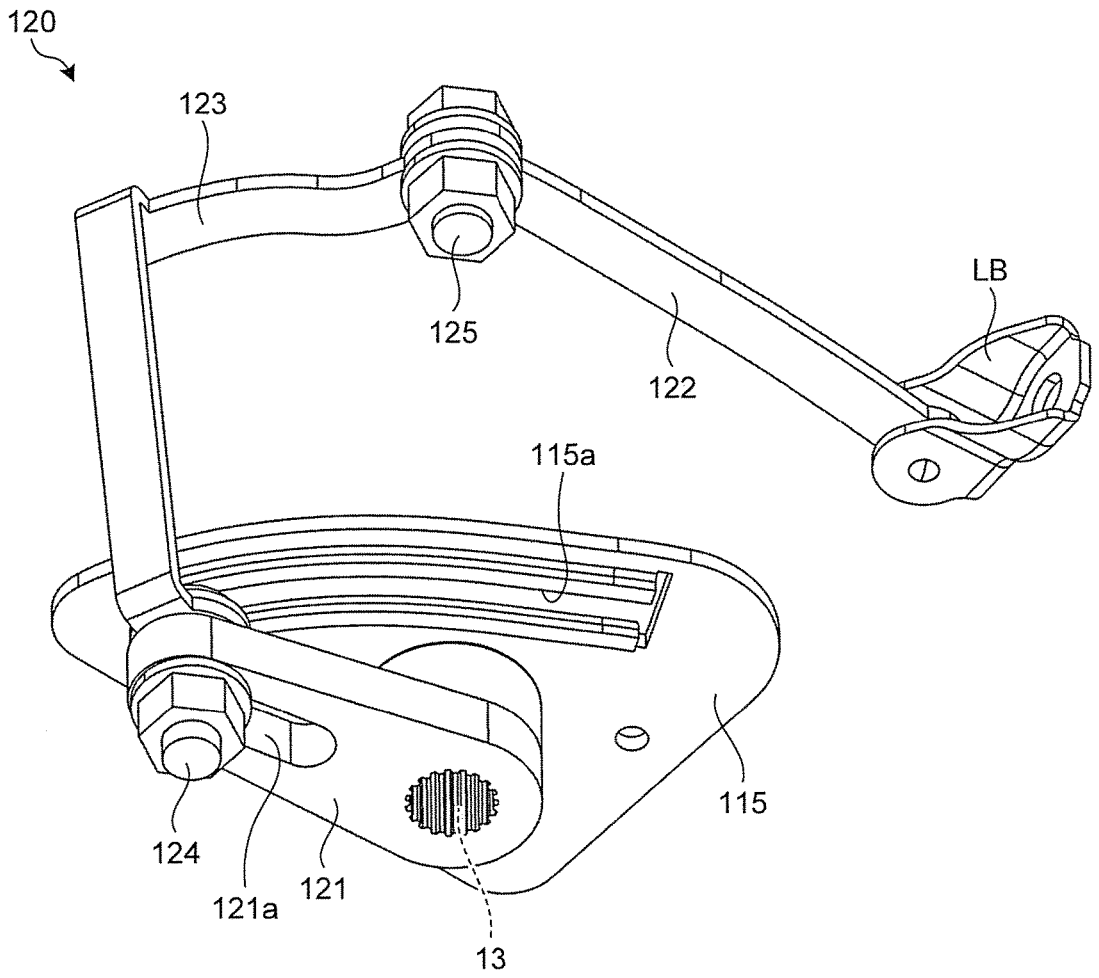
FIG. 12 is an external perspective view of a link mechanism of the door operator applied to the vehicle illustrated in FIG. 9, as viewed upward at an angle.
Figure 13:
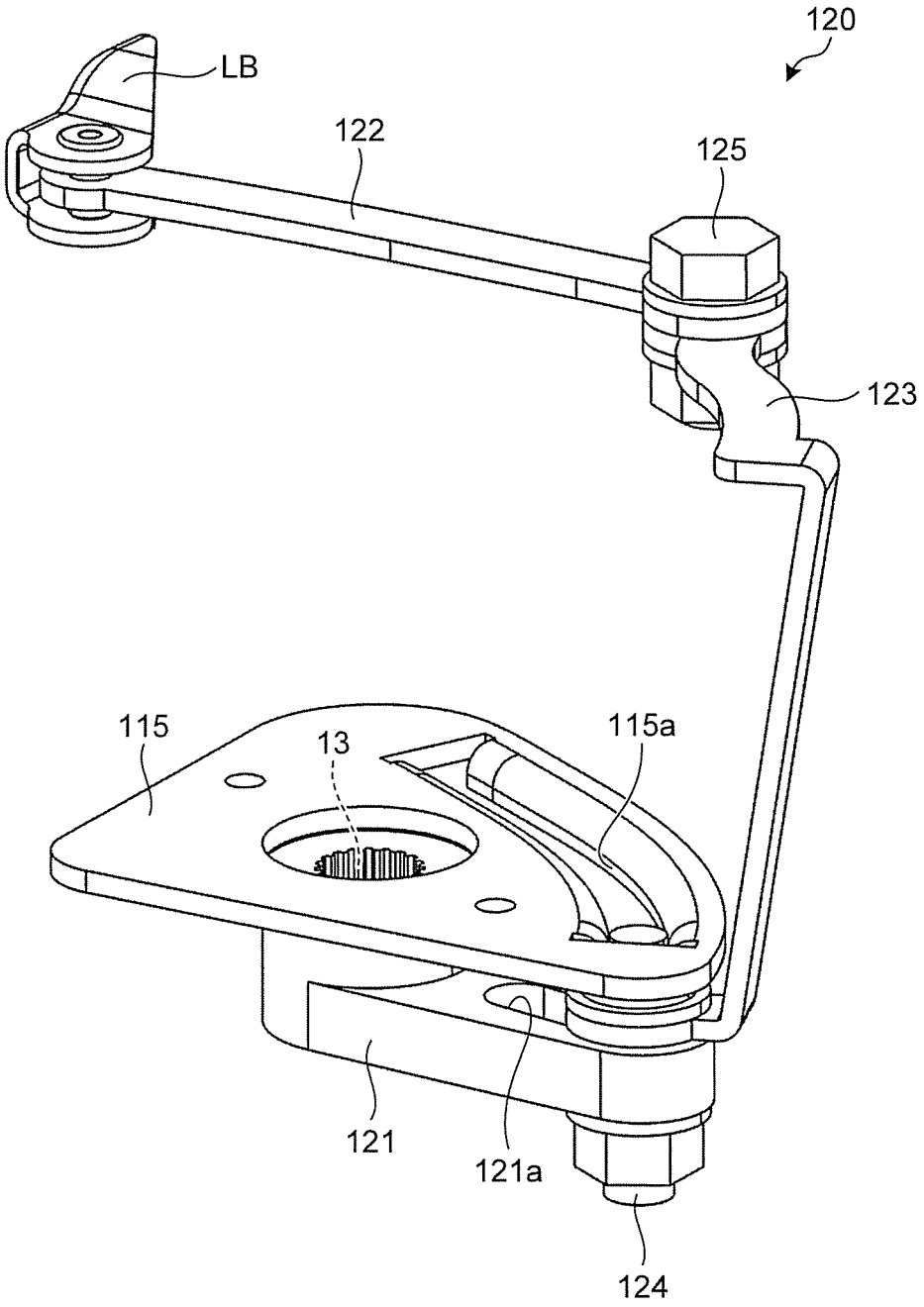
FIG. 13 is an external perspective view of the link mechanism of the door operator applied to the vehicle illustrated in FIG. 9, as viewed downward at an angle.
Figure 14:
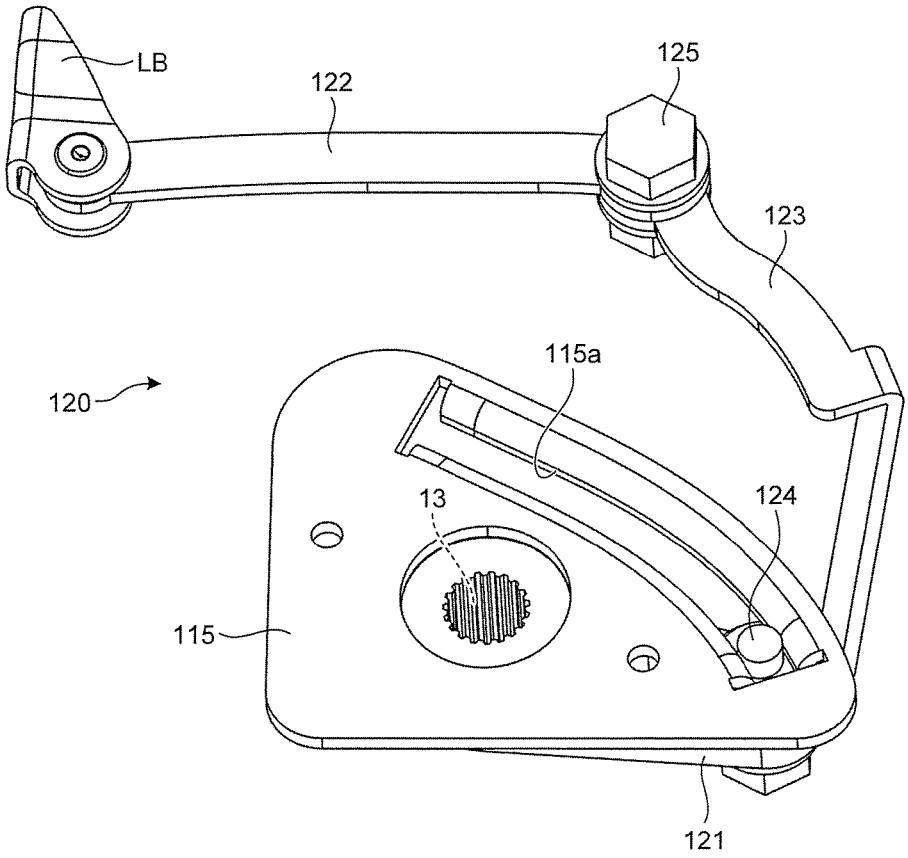
FIG. 14 is an external perspective view of the link mechanism of the door operator applied to the vehicle illustrated in FIG. 9, as viewed downward at another angle.

FIG. 9 illustrates a principal part of a vehicle to which a door operator according to a second embodiment of the present disclosure is applied. The vehicle illustrated in this case is a four-door, four-wheel vehicle provided with a front side door D and a rear side door D on each of both sides of a vehicle body B as with the first embodiment, and includes a drive unit 110 in inner space A of the side door D. As illustrated in FIGS. 10 and 11, the drive unit 110 includes an electric motor 11 to be a driving source, a decelerator 12 and an output shaft 13, where a detailed structure of a link mechanism 120 interposed between the output shaft 13 and the vehicle body B is different from that of the first embodiment. The structure of the link mechanism 120 will now be described in detail while omitting detailed description of each structure similar to that of the first embodiment by assigning the same reference numeral to the similar structures.

That is, in the second embodiment, the link mechanism 120 includes a driving arm 121 fixed to the output shaft 13, an intermediate arm 123 connected to a tip end of the driving arm 121, and a driven arm 122 connecting a pillar BP of the vehicle body B and the intermediate arm 123, the pillar facing a front face DMF of the side door D.

The driving arm 121 extends along a radial direction from the output shaft 13. A groove 121*a* is formed at the tip end of the driving arm 121 along a direction of extension thereof. In the second embodiment, as illustrated in FIG. 9, the driving arm 121 is in a standby state when the tip end extends toward a back side of the vehicle. When the electric motor 11 is driven from this state, the driving arm 121 may be turned to a position where the tip end of the arm faces the inner side of the vehicle while the tip end passes the inner side of the vehicle relative to the output shaft 13. A base end of the intermediate arm 123 is turnably connected to the tip end of the driving arm 121 through a connecting pin (positioning pin) 124. The connecting pin 124 is arranged to be able to move along the groove 121*a* in the driving arm 121. As illustrated in FIGS. 11 to 14, the intermediate arm 123 applied in the second embodiment is one that extends upward along the output shaft 13 from one end at the base end of the arm extending along the driving arm 121 and then extends horizontally with the tip end being bent. A base end of the driven arm 122 is turnably connected to the pillar BP of the vehicle body B through a link bracket LB. A tip end of the driven arm 122 is turnably connected to the tip end of the intermediate arm 123 through a connecting pin 125. Each of the connecting pin 124 between the driving arm 121 and the intermediate arm 123, the connecting pin 125 between the intermediate arm 123 and the driven arm 122 and a pivot core C1 of the driven arm 122 and the link bracket LB is set to be substantially parallel to a shaft core 13C of the output shaft 13. As is apparent from the figures, the length of the driven arm 122 is set such that the arm extends along the front and back of the vehicle when the driving arm 121 is in the standby state with the side door D closed. Likewise, the length of the intermediate arm 123 is set such that the arm extends from the tip end of the driving arm 121 toward the inner side of the vehicle while being tilted to the front, when the driving arm 121 is in the standby state with the side door D closed.

The connecting pin 124 connecting the driving arm 121 and the intermediate arm 123 projects upward, where an end of the projection is inserted into a slide groove 115*a* of a guide plate 115. The guide plate 115 is a plate-like member fixed to a lower part of the drive unit 110 and extends to be substantially orthogonal to the output shaft 13. The slide groove 115*a* is positioned at a tip end of the driving arm 121 when the driving arm 121 is in the standby state as illustrated in FIG. 9, and extends from the tip end to the front of the vehicle toward a part corresponding to the inner side of the vehicle relative to the output shaft 13. More specifically, the slide groove 115*a* is curved to be slightly convex toward the inner side of the vehicle while getting gradually closer to the output shaft 13 as it tends to the front of the vehicle.

Figure 15A:
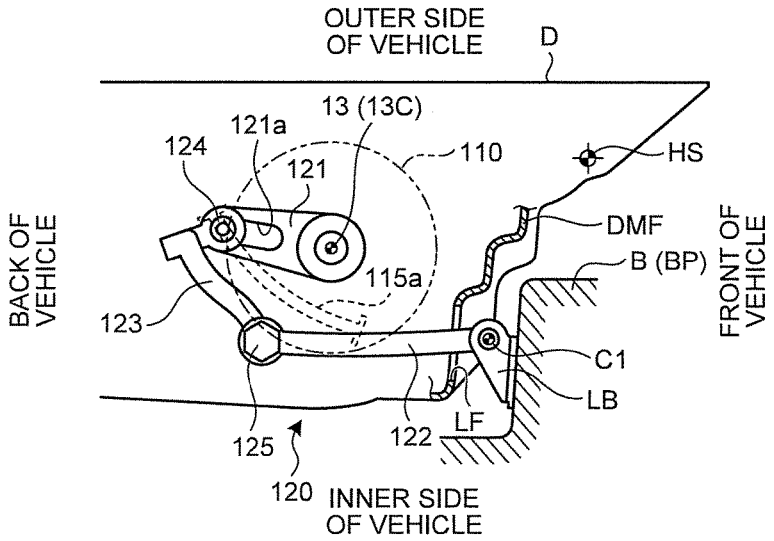
FIGS. 15A to 15C are diagrams schematically illustrating an area of connection between the side door and the vehicle body of the vehicle illustrated in FIG. 9, where

According to the door operator configured as described above, when the electric motor 11 of the drive unit 110 in the standby state with the side door D closed as illustrated in FIG. 15A is driven, the rotation of the output shaft 13 is transmitted to the driven arm 122 through the driving arm 121 and the intermediate arm 123 to push the driven arm 122 frontward. As a result, when the drive unit 110 is operated while a striker (not illustrated) provided to the vehicle body B and a latch device provided to the side door D are disengaged, for example, the driven arm 122 gradually projects frontward to the outside from the front face DMF of the side door D to thus open up the side door D with respect to the vehicle body B about a hinge axis HS, as illustrated in FIGS. 15B and 15C.

Figure 15B:
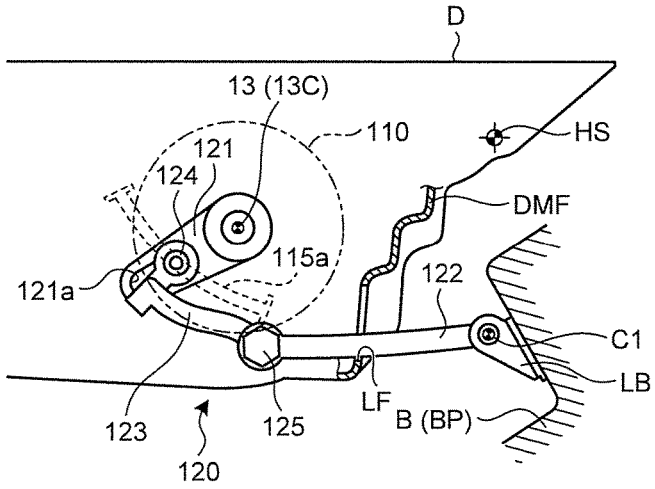
Figure 15C:
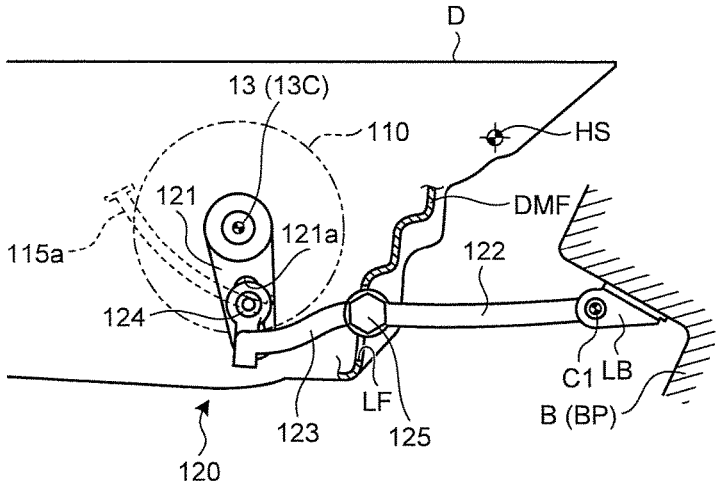

On the other hand, when the electric motor 11 of the drive unit 110 is rotated in a reverse direction from the state in which the side door D is open, the driven arm 122 moves backward to be accommodated in the inner space A of the side door D as from a state illustrated in FIG. 15C to a state illustrated in FIG. 15B, so that the side door D may be closed with respect to the vehicle body B as illustrated in FIG. 15A.

The drive unit 110 is configured to allow for a change in distance from the connecting pin 124 being a relative pivot core of the driving arm 121 and the intermediate arm 123 to the shaft core 13C of the output shaft 13 while the aforementioned operations are in action, and at the same time the connecting pin 124 is guided along the slide groove 115*a* provided in the guide plate 115. As a result, the driven arm 122 does not move much toward the inner and outer sides of the vehicle body B even when the driving arm 121 is turned to a considerable extent to open the side door D widely. Therefore, according to the vehicle to which the aforementioned door operator is applied, the side door D may be opened and closed at a wide turning angle without the need to set a large dimension to a notch LF provided on the front face DMF of the side door D or provide a clearance in the pillar BP of the vehicle body B facing the notch. Moreover, according to the drive unit 110 accommodated in the side door D, only the driven arm 122 is exposed to the outside from the front face DMF of the side door D so that there is no influence on a cabin of the vehicle nor are the comfort of getting in and out of the vehicle and the interior comfort impaired.

Third Embodiment

While the second embodiment is configured to provide the groove 121*a* in the driving arm 121 and arrange the connecting pin 124 connecting the driving arm and the intermediate arm 123 to be able to move along the groove 121*a*, the groove 121*a* may instead be provided in the intermediate arm 123 as illustrated in a third embodiment below.

Figure 16:
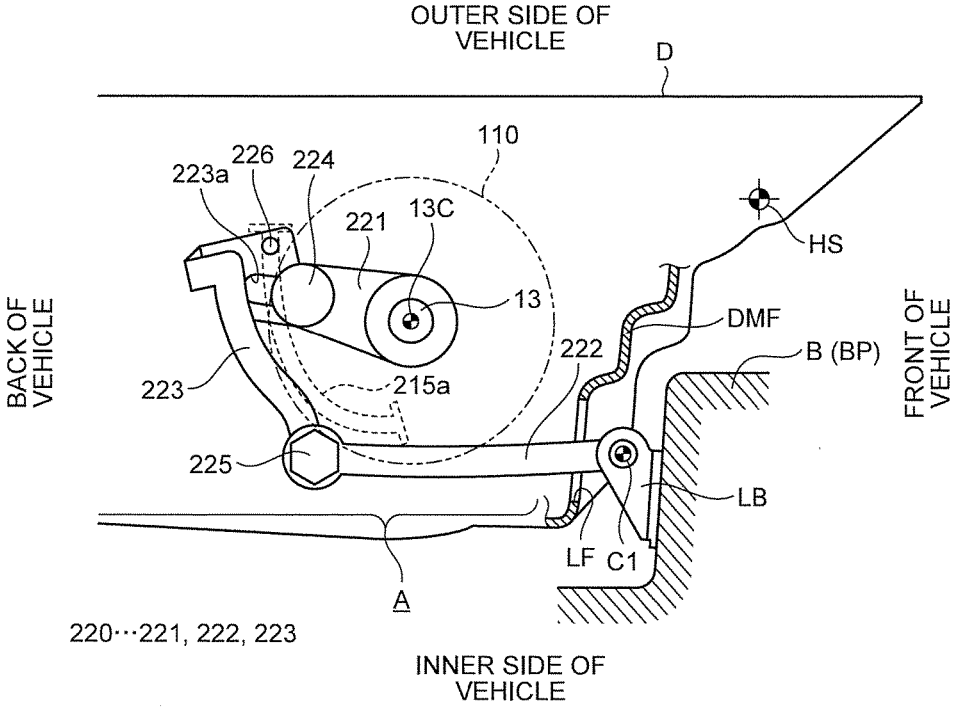
FIG. 16 is an enlarged plan view schematically illustrating an area of connection between a side door and a vehicle body of a vehicle according to a third embodiment of the present disclosure.

FIG. 16 illustrates a principal part of a vehicle to which a door operator according to a third embodiment of the present disclosure is applied. The vehicle illustrated in this case is a four-door, four-wheel vehicle provided with a front side door D and a rear side door D on each of both sides of a vehicle body B as with the second embodiment, where only a structure of a link mechanism 220 provided between the drive unit 110 and the vehicle body B is different from the structure in the second embodiment. The structure of the link mechanism 220 will now be described in detail while omitting detailed description of each structure similar to that of the second embodiment by assigning the same reference numeral to the similar structures.

The link mechanism 220 of the third embodiment includes a driving arm 221 fixed to an output shaft 13, an intermediate arm 223 connected to a tip end of the driving arm 221, and a driven arm 222 connecting a pillar BP of the vehicle body B and the intermediate arm 223, the pillar facing a front face DMF of the side door D.

Figure 17:
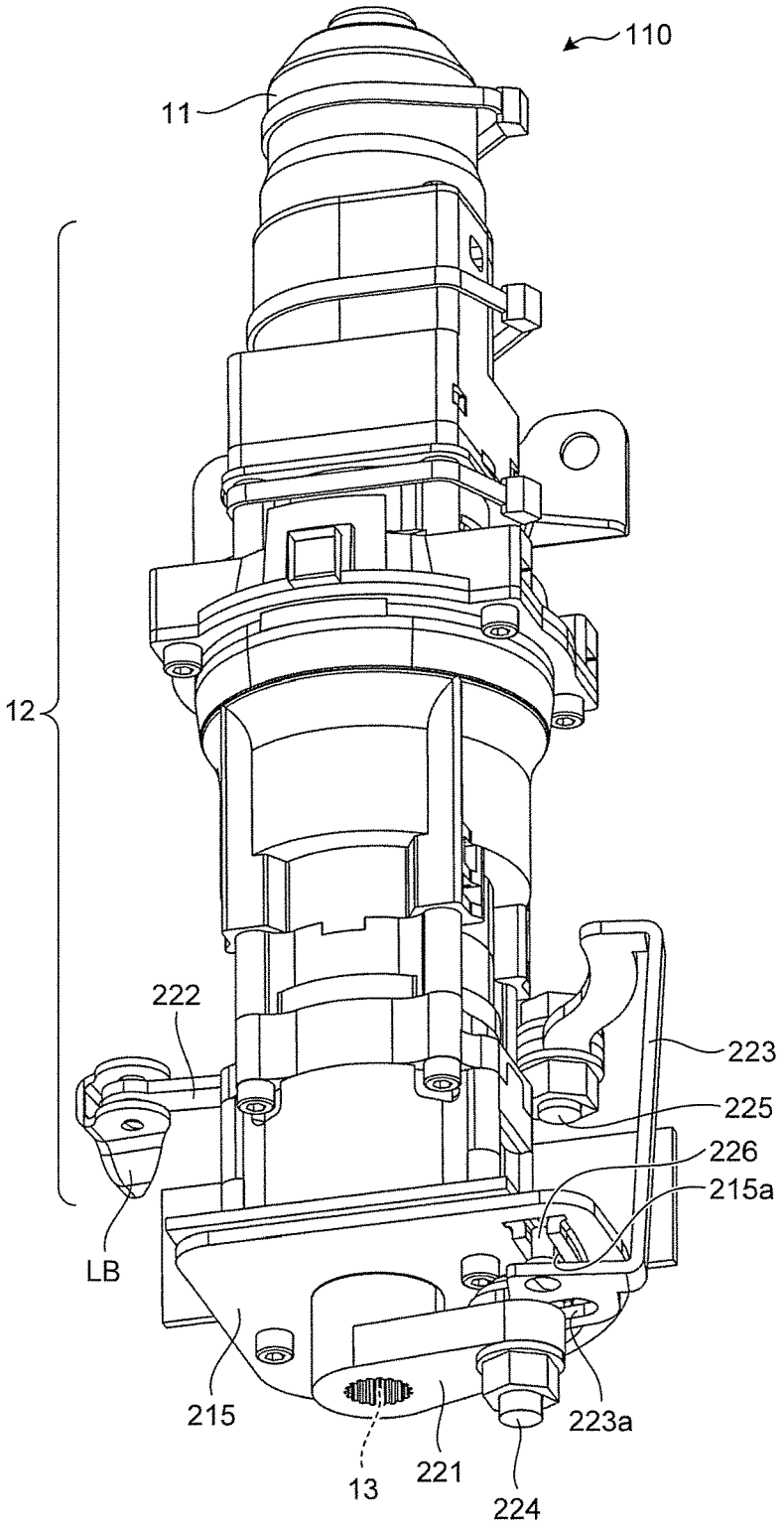
FIG. 17 is an external perspective view of a door operator applied to the vehicle illustrated in FIG. 16 and viewed upward at an angle.
Figure 18:
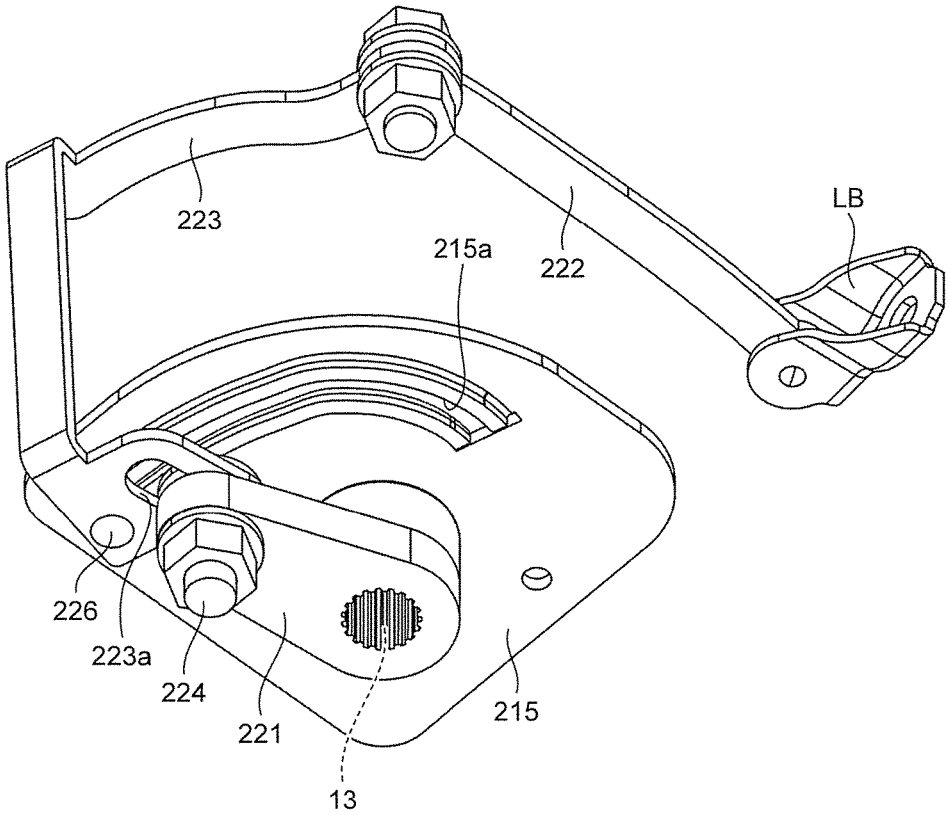
FIG. 18 is an external perspective view of a link mechanism of the door operator applied to the vehicle illustrated in FIG. 16, as viewed upward at an angle.
Figure 19:
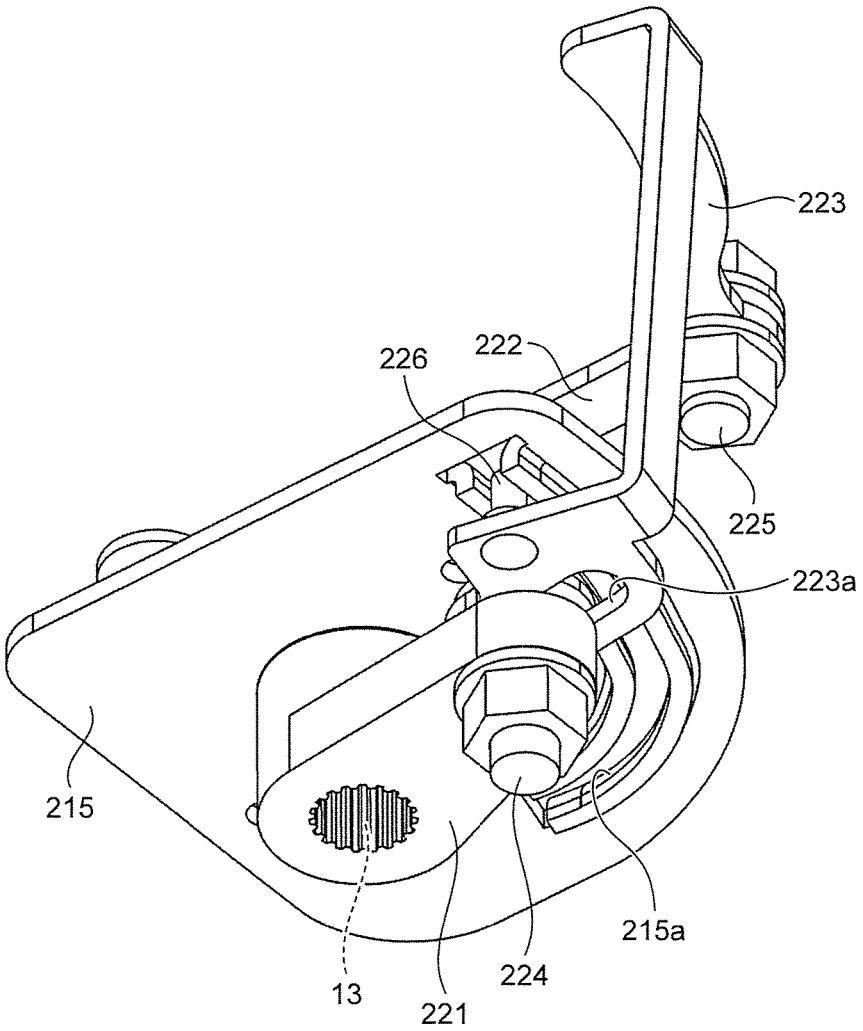
FIG. 19 is an external perspective view of the link mechanism of the door operator applied to the vehicle illustrated in FIG. 16, as viewed upward at another angle.

The driving arm 221 extends along a radial direction from the output shaft 13. In the third embodiment, as with the second embodiment, the driving arm 221 is in a standby state when the tip end extends toward a back side of the vehicle. When an electric motor 11 is driven from this state, the driving arm 221 may be turned to a position where the tip end of the arm faces the inner side of the vehicle while the tip end passes the inner side of the vehicle relative to the output shaft 13. The intermediate arm 223 includes a groove 223*a* at a base end of the arm and is turnably connected to the tip end of the driving arm 221 through a connecting pin 224. The connecting pin 224 is arranged to be able to move along the groove 223*a* in the intermediate arm 223. As illustrated in FIGS. 17 to 19, the intermediate arm 223 applied in the third embodiment is one that extends upward along the output shaft 13 from one end at the base end of the arm extending along the driving arm 221 and then extends horizontally with a tip end being bent. A base end of the driven arm 222 is turnably connected to the pillar BP of the vehicle body B through a link bracket LB. A tip end of the driven arm 222 is turnably connected to the tip end of the intermediate arm 223 through a connecting pin 225. Each of the connecting pin 224 between the driving arm 221 and the intermediate arm 223, the connecting pin 225 between the intermediate arm 223 and the driven arm 222 and a pivot core C1 of the driven arm 222 and the link bracket LB is set to be substantially parallel to a shaft core 13C of the output shaft 13. As is apparent from FIG. 16, the intermediate arm 223 is configured to be tilted frontward from the tip end of the driving arm 221 toward the inner side of the vehicle, when the driving arm 221 is in the standby state with the side door D closed while at the same time the groove 223*a* is arranged along a direction in which the driving arm 221 extends. Likewise, the length of the driven arm 222 is set such that the arm extends along the front and back of the vehicle when the driving arm 221 is in the standby state with the side door D closed while at the same time the groove 223*a* in the intermediate arm 223 is arranged along the direction in which the driving arm 221 extends.

A positioning pin 226 is provided at the base end of the intermediate arm 223 as illustrated in FIG. 17. The positioning pin 226 is a columnar member extending substantially vertically upward from the intermediate arm 223, where an extended end of the pin is inserted into a slide groove 215*a* of a guide plate 215. The guide plate 215 is a plate-like member fixed to a lower part of the drive unit 110 and extends to be substantially orthogonal to the output shaft 13. The slide groove 215*a* is positioned at the tip end of the driving arm 221 when the driving arm 221 is in the standby state as illustrated in FIG. 16, and extends from the tip end to the front of the vehicle toward a part corresponding to the inner side of the vehicle relative to the output shaft 13. More specifically, the slide groove 215*a* is curved to be convex toward the back and inner sides of the vehicle while getting gradually closer to the output shaft 13 as it tends to the front of the vehicle.

Although not clearly illustrated in the figures, the door operator configured as described above is also configured such that, when the electric motor 11 of the drive unit 110 in the standby state with the side door D closed is driven, the rotation of the output shaft 13 is transmitted to the driven arm 222 through the driving arm 221 and the intermediate arm 223 to push the driven arm 222 frontward. As a result, when the drive unit 110 is operated while a striker provided to the vehicle body B and a latch device provided to the side door D are disengaged, for example, the driven arm 222 gradually projects frontward to the outside from the front face DMF of the side door D to thus open up the side door D with respect to the vehicle body B about a hinge axis HS.

On the other hand, when the electric motor 11 of the drive unit 110 is rotated in a reverse direction from the state in which the side door D is open, the driven arm 222 moves backward to be accommodated in the inner space A of the side door D, so that the side door D may be closed with respect to the vehicle body B.

The drive unit 110 is configured to allow for a change in distance from the groove 223*a*, to which the connecting pin 224 being a relative pivot core of the driving arm 221 and the intermediate arm 223 is connected, to the shaft core 13C of the output shaft 13 while the aforementioned operations are in action, and at the same time the connecting pin 224 is guided along the slide groove 215*a* provided in the guide plate 215. As a result, the driven arm 222 does not move much toward the inner and outer sides of the vehicle body B even when the driving arm 221 is turned to a considerable extent to open the side door D widely. Therefore, according to the vehicle to which the aforementioned door operator is applied, the side door D may be opened and closed at a wide turning angle without the need to provide a large notch LF on the front face DMF of the side door D or provide a large clearance in the pillar BP of the vehicle body B facing the notch. Moreover, according to the drive unit 110 accommodated in the side door D, only the driven arm 222 is exposed to the outside from the front face DMF of the side door D so that there is no influence on a cabin of the vehicle nor are the comfort of getting in and out of the vehicle and the interior comfort impaired.

Note that while the vehicle including four side doors D is illustrated in each of the first to third embodiments, the number of side doors D need not be four doors. Moreover, the hinge H need not be positioned on the front face DMF of the side door D but may be provided between a back face of the side door D and the vehicle body B. The number of hinges H is not limited to two, either.

According to the present disclosure, the drive unit is arranged in the inner space of the side door, whereby opening and closing of the side door may be assisted without impairing the comfort of getting in and out of the vehicle and the interior comfort. What is more, the driving arm extending radially from the output shaft of the drive unit and the driven arm turnably connected to the vehicle body are connected to each other while allowing for a change in distance from the relative pivot core to the shaft core of the output shaft, so that a large stroke may be obtained without the driven arm moving much toward inner and outer sides of the vehicle body and that a dimension of a clearance such as a notch securing the area of movement for the driven arm in the side door and the vehicle body may be set small.

Moreover, according to the present disclosure, the drive unit is arranged in the inner space of the side door, whereby opening and closing of the side door may be assisted without impairing the comfort of getting in and out of the vehicle and the interior comfort. What is more, the driving arm extending radially from the output shaft of the drive unit and the intermediate arm turnably connected to the tip end of the driving arm are connected to each other while allowing for a change in distance from the relative pivot core to the shaft core of the output shaft, so that the large stroke may be obtained without the driven arm moving much toward inner and outer sides of the vehicle body and that the dimension of the clearance such as the notch securing the area of movement for the driven arm in the side door and the vehicle body may be set small.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door operator adapted to open and close a side door supported on a side of a vehicle body through a hinge, the door operator comprising:

a drive unit arranged in an inner space of the side door; and a link mechanism configured to connect an output shaft of the drive unit and the vehicle body, the link mechanism including a driving arm extending radially from the output shaft of the drive unit, and a driven arm including a first end turnably connected to the vehicle body, and a second end separately formed from the first end and turnably connected to the driving arm through a rotation shaft, wherein the driven arm is configured to rotate about the rotation shaft with respect to the driving arm, the link mechanism is configured to open, and close the side door with respect to the vehicle body through the driving arm and the driven arm when the drive unit is driven, and the driven arm and the driving arm are connected to each other while allowing for a change in distance from a shaft core of the rotation shaft to a shaft core of the output shaft.

2. The door operator according to claim 1, wherein the driving arm includes:

a first arm element fixed to the output shaft while extending along a radial direction from the output shaft; and a second arm element slidable along a radial direction of the output shaft with respect to the first arm element, and the driven arm is turnably connected to one end of the second arm element.

3. The door operator according to claim 2, wherein the second arm element has a groove along the radial direction of the output shaft to fix the output shaft to the first arm element through the groove.

4. The door operator according to claim 2, wherein the second arm element is provided with a projecting positioning pin which is covered with a guide plate arranged in the drive unit, the guide plate has a slide groove, and a slide position of the second arm element with respect to the first arm element is specified according to a turning angle of the driving arm by inserting a projecting end of the positioning pin into the slide groove.

5. A door operator adapted to open and close a side door supported on a side of a vehicle body through a hinge, the door operator comprising:

a drive unit arranged in an inner space of the side door; and a link mechanism configured to connect an output shaft of the drive unit and the vehicle body, the link mechanism including a driving arm extending radially from the output shaft of the drive unit, a driven arm turnably connected to the vehicle body, and an intermediate arm including a first end turnably connected to a tip end of the driving arm through a rotation shaft, and a second end separately formed from the first end and turnably connected to the driven arm, wherein the intermediate arm is configured to rotate about the rotation shaft with respect to the driving arm, the link mechanism is configured to open and close the side door with respect to the vehicle body through the driving arm, the intermediate arm and the driven arm when the drive unit is driven, and the intermediate arm and the driving arm are connected to each other while allowing for a change in distance from a shaft core of the rotation shaft to a shaft core of the output shaft.

6. The door operator according to claim 5, wherein the driving arm has a groove along a radial direction, and the rotation shaft connecting the driving arm and the intermediate arm is slidably arranged in the groove.

7. The door operator according to claim 6, wherein a guide plate is arranged in the drive unit to cover the rotation shaft, the guide plate has a slide groove, and a position at which the rotation shaft is arranged with respect to the groove is specified according to a turning angle of the driving arm by arranging the rotation shaft in the slide groove.

8. The door operator according to claim 5, wherein the intermediate arm has a groove along a direction in which the driving arm extends, and the rotation shaft connecting the driving arm and the intermediate arm is slidably arranged in the groove.

9. The door operator according to claim 8, wherein the intermediate arm is provided with a projecting positioning pin which is covered with a guide plate arranged in the drive unit, the guide plate has a slide groove, and a position at which the rotation shaft is arranged with respect to the groove is specified according to a turning angle of the driving arm by inserting a projecting end of the positioning pin into the slide groove.

* * * * *